US008823609B2

(12) United States Patent
Chung

(10) Patent No.: US 8,823,609 B2
(45) Date of Patent: Sep. 2, 2014

(54) PIXEL CIRCUIT, ORGANIC ELECTRO-LUMINESCENT DISPLAY APPARATUS USING THE PIXEL CIRCUIT AND METHOD OF DRIVING THE APPARATUS

(75) Inventor: Kyung-Hoon Chung, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 430 days.

(21) Appl. No.: 12/766,387

(22) Filed: Apr. 23, 2010

(65) Prior Publication Data

US 2011/0080395 A1 Apr. 7, 2011

(30) Foreign Application Priority Data

Oct. 7, 2009 (KR) ..... 10-2009-0095172

(51) Int. Cl.
*G09G 3/30* (2006.01)
*G09G 3/32* (2006.01)

(52) U.S. Cl.
CPC ..... *G09G 3/3233* (2013.01); *G09G 2300/0861* (2013.01); *G09G 2300/043* (2013.01); *G09G 2300/0819* (2013.01); *G09G 2310/0262* (2013.01)
USPC ..... 345/76; 345/82

(58) Field of Classification Search
CPC ..... G09G 3/3233
USPC ..... 345/76, 82, 211
See application file for complete search history.

(56) References Cited

U.S. PATENT DOCUMENTS

| | | | | |
|---|---|---|---|---|
| 2006/0139255 | A1* | 6/2006 | Kim et al. | 345/76 |
| 2006/0244695 | A1 | 11/2006 | Komiya | |
| 2007/0057873 | A1* | 3/2007 | Uchino et al. | 345/76 |
| 2008/0048949 | A1* | 2/2008 | Kim | 345/80 |
| 2008/0106504 | A1* | 5/2008 | Wei et al. | 345/82 |
| 2008/0142827 | A1* | 6/2008 | Choi et al. | 257/98 |
| 2008/0211747 | A1* | 9/2008 | Kim | 345/76 |
| 2008/0224965 | A1* | 9/2008 | Kim | 345/76 |

FOREIGN PATENT DOCUMENTS

| | | |
|---|---|---|
| KR | 10-2006-0056790 | 5/2006 |
| KR | 10-2006-0114456 | 11/2006 |
| KR | 10-2007-0002155 | 1/2007 |
| KR | 10-2007-0019463 | 2/2007 |
| KR | 10-0805608 | 2/2008 |
| KR | 10-2008-0056098 | 6/2008 |

OTHER PUBLICATIONS

Machine based English translation of Korean Publication 10-2007-0019463 submitted in Applicant's IDS of Jun. 16, 2011.*
KIPO Notice of Allowance for Korean priority application No. 10-2009-0095172, dated Mar. 24, 2011.

* cited by examiner

*Primary Examiner* — Chanh Nguyen
*Assistant Examiner* — John Kirkpatrick
(74) *Attorney, Agent, or Firm* — Christie, Parker & Hale, LLP

(57) ABSTRACT

An organic electroluminescent display apparatus including a pixel circuit and a method of driving the organic electroluminescent display apparatus are provided. Embodiments of the present invention may solve problems where the luminance of light is changed due to a change of a voltage of an anode of an organic electro-light emitting device such that an image quality is deteriorated when N-type transistors are used to form the organic electroluminescent display apparatus.

19 Claims, 8 Drawing Sheets

PIXEL CIRCUIT, ORGANIC ELECTRO-LUMINESCENT DISPLAY APPARATUS USING THE PIXEL CIRCUIT AND METHOD OF DRIVING THE APPARATUS

CROSS-REFERENCE TO RELATED APPLICATIONS

This application claims priority to and the benefit of Korean Patent Application No. 10-2009-0095172, filed on Oct. 7, 2009, in the Korean Intellectual Property Office, the disclosure of which is incorporated herein in its entirety by reference.

BACKGROUND

1. Field

Aspects of one or more embodiments of the present invention relate to a pixel circuit, an organic electroluminescent display apparatus using the pixel circuit, and a method of driving the organic electroluminescent display apparatus.

2. Description of the Related Art

Display apparatuses apply a data driving signal, which corresponds to input data, to a plurality of pixel circuits so as to control the luminance of each of the pixels and to convert the input data into an image that is provided to a viewer. The data driving signal to be output to the plurality of pixel circuits is generated from a data driving unit. The data driving unit selects a gamma voltage, which corresponds to the input data, from among a plurality of gamma voltages generated from a gamma filter circuit unit, and outputs the selected gamma voltage as a data driving signal of the plurality of pixel circuits.

SUMMARY

One or more embodiments of the present invention provide a pixel circuit of an organic electroluminescent display apparatus including the pixel circuit and a method of driving the organic electroluminescent display apparatus which may solve problems where the luminance of light is changed due to a change of a voltage level of an anode of an organic electro-light emitting device such that image quality is deteriorated, when N-type transistors are used to form the organic electroluminescent display apparatus.

According to an embodiment of the present invention, there is provided a pixel circuit for driving a light emitting device including a first electrode and a second electrode, the pixel circuit including: a driving transistor including a first electrode and a second electrode for outputting a driving current according to a voltage applied to a gate electrode of the driving transistor; a second transistor for delivering a data signal to the gate electrode of the driving transistor in response to a scan control signal applied to a gate electrode of the second transistor; a third transistor for diode-connecting the driving transistor in response to the scan control signal applied to a gate electrode of the third transistor; a fourth transistor for applying an initialization voltage to the gate electrode of the driving transistor in response to an initialization control signal; a fifth transistor for applying a first power voltage to the second electrode of the driving transistor in response to an emission control signal; a sixth transistor coupled in series between the first electrode of the driving transistor and the first electrode of the light emitting device for outputting the driving current output from the driving transistor to the first electrode of the light emitting device in response to the emission control signal applied to a gate electrode of the sixth transistor; a seventh transistor for applying a reference voltage to the first electrode of the light emitting device in response to the scan control signal; and a capacitor including a first electrode and a second electrode, wherein the first electrode is coupled to the gate electrode of the driving transistor and the second electrode is coupled to the first electrode of the light emitting device, wherein the pixel circuit is configured such that the data signal is delivered to the gate electrode of the driving transistor through the second transistor, the driving transistor, and the third transistor, and wherein the driving transistor and the second, third, fourth, fifth, sixth, and seventh transistors are N-type transistors. The light emitting device may include an organic light-emitting diode.

The second transistor may include a first electrode for receiving the data signal and a second electrode coupled to the second electrode of the driving transistor, and the third transistor may include a first electrode coupled to the gate electrode of the driving transistor and a second electrode coupled to the first electrode of the driving transistor.

The initialization voltage may be substantially the same as the first power voltage.

The second transistor may include a first electrode coupled to the data signal and a second electrode coupled to the first electrode of the driving transistor, and the third transistor may include a first electrode coupled to the gate electrode of the driving transistor and a second electrode coupled to the second electrode of the driving transistor. The initialization voltage may be the first power voltage.

The second electrode of the light emitting device may be configured to receive a second power voltage, and the reference voltage may be lower than a sum of the second power voltage and a threshold voltage of the light emitting device. Accordingly, the reference voltage is set to a voltage level at which the light emitting device is not emitted.

The initialization control signal may be a scan control signal of a previous scan period. Also, the driving transistor and the second, third, fourth, fifth, sixth, and seventh transistors may be N-type metal-oxide semiconductor field effect transistors.

The first electrode of the driving transistor may be a source electrode, and the second electrode of the driving transistor may be a drain electrode.

The pixel circuit may be configured such that: during a first time duration, when the initialization control signal may be at a first level, the scan control signal and the emission control signal may be at a second level; during a second time duration, when the data signal has a valid level, the initialization control signal and the emission control signal may be at the second level, and the scan control signal may be at the first level; and during a third time duration, when the initialization control signal and the scan control signal may be at the second level, the emission control signal may be at the first level, and wherein the first level may be a level at which the driving transistor and the second, third, fourth, fifth, sixth, and seventh transistors are turned on, and the second level may be a level at which the driving transistor and the second, third, fourth, fifth, sixth, and seventh transistors are turned off.

According to another embodiment of the present invention, there is provided an organic electroluminescent display apparatus including: a pixel array including a plurality of pixels; a scan driver configured to output an initialization control signal, a scan control signal, and an emission control signal to the plurality of pixels; and a data driver configured to generate a data signal and output the data signal to the plurality of pixels, wherein each of the plurality of pixels includes: an organic light-emitting diode (OLED) including a first electrode and a second electrode; a driving transistor including a first electrode and a second electrode for outputting a driving current according to a voltage applied to a gate electrode of the driving transistor; a second transistor for delivering a data signal to the gate electrode of the driving transistor in response to a scan control signal applied to a gate electrode of the second transistor; a third transistor for diode-connecting the driving transistor in response to the scan control signal applied to a gate electrode of the third transistor; a fourth transistor for applying an initialization voltage to the gate electrode of the driving transistor in response to an initialization control signal; a fifth transistor for applying a first power voltage to the second electrode of the driving transistor in response to an emission control signal; a sixth transistor coupled in series between the first electrode of the driving transistor and the first electrode of the OLED for outputting the driving current output from the driving transistor to the first electrode of the OLED in response to the emission control signal applied to a gate electrode of the sixth transistor; a seventh transistor for applying a reference voltage to the first electrode of the OLED in response to the scan control signal; and a capacitor including a first electrode and a second electrode, wherein the first electrode is coupled to the gate electrode of the driving transistor and the second, electrode is coupled to the first electrode of the OLED, wherein the second transistor is configured to deliver the data signal to the gate electrode of the driving transistor through the second transistor, the driving transistor, and the third transistor, and wherein the driving transistor and the second, third, fourth, fifth, sixth, and seventh transistors are N-type transistors.

According to another embodiment of the present invention, there is provided a method of driving an organic electroluminescent display apparatus including a pixel array including a plurality of pixels, wherein each of the plurality of pixels includes an organic light-emitting diode (OLED) and a pixel circuit including N-type transistors and a capacitor coupled between a gate electrode of a driving transistor and an anode of the OLED, the method including: initializing the gate electrode of the driving transistor to an initialization voltage; initializing the anode of the OLED to a reference voltage; charging the capacitor to a voltage level corresponding to a sum of a threshold voltage of the driving transistor and a data signal by diode-connecting the driving transistor and applying the data signal to the gate electrode of the driving transistor; and outputting a driving current from the driving transistor to the anode of the OLED according to the voltage level charged to the capacitor.

BRIEF DESCRIPTION OF THE DRAWINGS

The above and other features and aspects of the present invention will become more apparent by describing in detail exemplary embodiments thereof with reference to the attached drawings in which.

DETAILED DESCRIPTION

Hereinafter, embodiments of the present invention will be described more fully with reference to the accompanying drawings. The detailed description and the drawings are provided for understanding aspects of the present invention, and the detailed descriptions of well-known technologies may be omitted. In addition, the specification and the drawings are not provided to limit the scope of the present invention. The terms and terminologies used herein are for the purpose of describing exemplary embodiments.

Unless specified otherwise, transistors described in the specification are N-type transistors, and may be, for example, N-type metal oxide semiconductor field effect transistors (MOSFETs) according to one embodiment.

Figure 1:
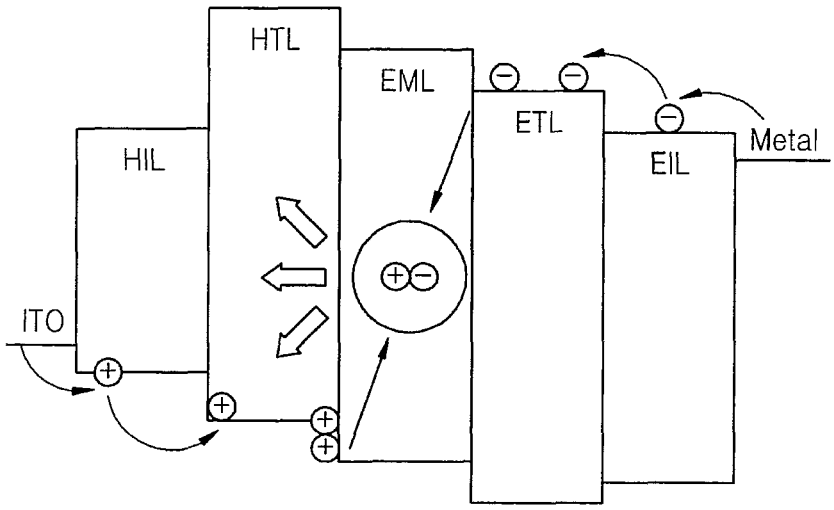
FIG. 1 is a diagram for explaining a luminescence principle of an organic electro-light emitting device.

FIG. 1 is a diagram for illustrating a luminescence principle of an organic electro-light emitting device.

An organic electroluminescent display apparatus electrically excites fluorescent organic compounds to emit light. In the organic electroluminescent display apparatus, organic electro-light emitting devices arranged in a matrix are voltage- or current-driven so as to display an image. The organic electro-light emitting devices have characteristics of a diode and thus are called organic light emitting diodes (OLEDs).

An OLED has a structure in which an anode (e.g., indium tin oxide (ITO)), an organic thin film, and a cathode (e.g., metal) are stacked together. In order to balance electrons and holes and thus improve luminance efficiency, the organic thin film includes an emitting layer (EML), an electron transport layer (ETL), and a hole transport layer (HTL). The organic thin film may further include a hole injection layer (HIL) or an electron injection layer (EIL).

A process for forming an amorphous silicon (a-Si) transistor may be performed with lower cost than a process for forming a poly-Si transistor. However, according to a characteristic of the a-Si transistor, typically, only N-type metal oxide semiconductor transistors may be used to form a pixel circuit. Also, according to a characteristic of an oxide thin-film transistor (TFT), typically, only N-type transistors may be used to form a pixel circuit.

Figure 2:
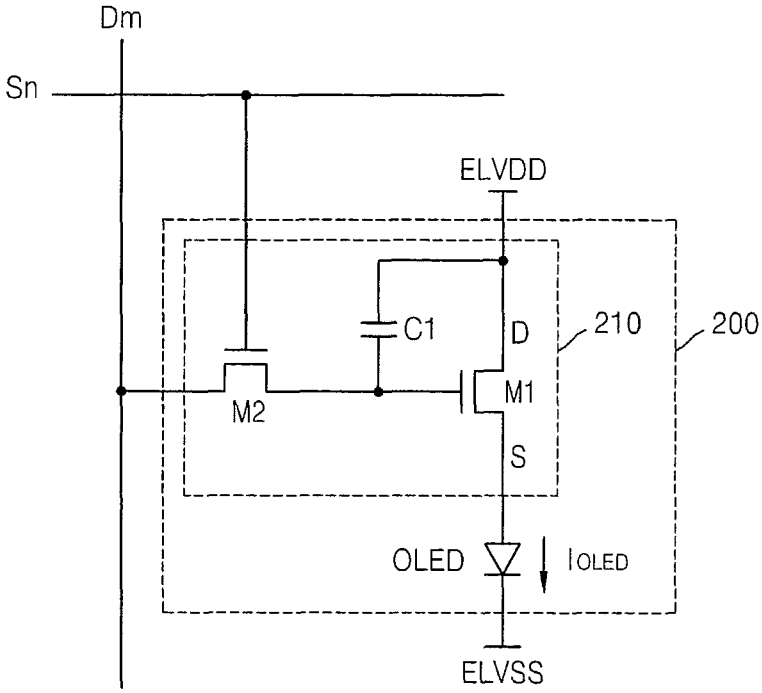
FIG. 2 is a diagram of a pixel circuit including N-type transistors.

FIG. 2 is a diagram of a pixel circuit 210 including N-type transistors.

An organic electroluminescent display apparatus includes a plurality of pixels 200 each including an OLED and the pixel circuit 210. The OLED receives driving current $I_{OLED}$ that is output from the pixel circuit 210 and emits light. The luminance of light emitted from the OLED varies according to amplitude of the driving current $I_{OLED}$.

In one embodiment, the pixel circuit 210 includes a capacitor C1, a driving transistor M1, and a second transistor M2.

When a scan control signal Sn is applied to a gate electrode of the second transistor M2, a data signal Dm is applied to a gate electrode of the driving transistor M1 and a first electrode of the capacitor C1 through the second transistor M2. While the data signal Dm is applied, a voltage level corresponding to that of the data signal Dm is charged between the terminals of the capacitor C1. According to the level of the data signal Dm, the driving transistor M1 generates the driving current $I_{OLED}$ and outputs the generated driving current $I_{OLED}$ to an anode of the OLED.

The OLED receives the driving current $I_{OLED}$ from the pixel circuit 210 and emits light having luminance corresponding to the data signal Dm.

The driving current $I_{OLED}$ output from the driving transistor M1 is determined according to Equation 1.

$$I_{OLED}=k(Vgs-Vth)^2 \quad \text{Equation 1}$$

Here, k is a constant, Vgs is a voltage between the gate electrode and a source electrode of the driving transistor M1, and Vth is a threshold voltage of the driving transistor M1. When a pixel circuit is formed by N-type transistors, a voltage level of the source electrode of the driving transistor M1 is determined by a voltage level of the anode of the OLED.

Vgs of the driving transistor M1 in the pixel circuit illustrated in FIG. 2 is given by Equation 2.

$$Vgs=V_{data}-(ELVSS+V_{OLED}) \quad \text{Equation 2}$$

Here, Vdata is a voltage level of the data signal Dm, and $V_{OLED}$ is a voltage between the electrodes of the OLED. As illustrated in Equation 2, Vgs of the driving transistor M1 is affected by a cathode power voltage ELVSS and $V_{OLED}$. In the case of a large-sized display apparatus, the value of Vgs varies due to an IR voltage drop by a parasitic resistance component of a wiring, which delivers the cathode power voltage ELVSS, and a voltage drop due to a current flowing into each pixel while the cathode power voltage ELVSS is delivered to each pixel. In addition, $V_{OLED}$ changes while the pixel is driven, and $V_{OLED}$ changes according to a change of a threshold voltage of the OLED due to degradation of the OLED.

When a voltage level of the gate electrode of the driving transistor M1 increases, the driving current $I_{OLED}$ increases and thereby the voltage $V_{OLED}$ applied between the terminals of the OLED increases. However, when the voltage $V_{OLED}$ increases, a voltage of the source electrode of the driving transistor M1 increases and thereby Vgs decreases, as illustrated in Equation 2. Accordingly, in order to generate light having desired luminance, the data voltage Vdata should increase in the above described example.

In the pixel circuit formed by N-type transistors, a voltage of the source electrode of the driving transistor M1 is unstable (e.g., varies) so that a luminance of a displayed image is changed and quality thereof is deteriorated.

According to embodiments of the present invention, a pixel circuit formed with N-type transistors may resolve the above described problems. Transistors included in pixel circuits, according to embodiments of the present invention that are described below, are N-type transistors.

Figure 3:
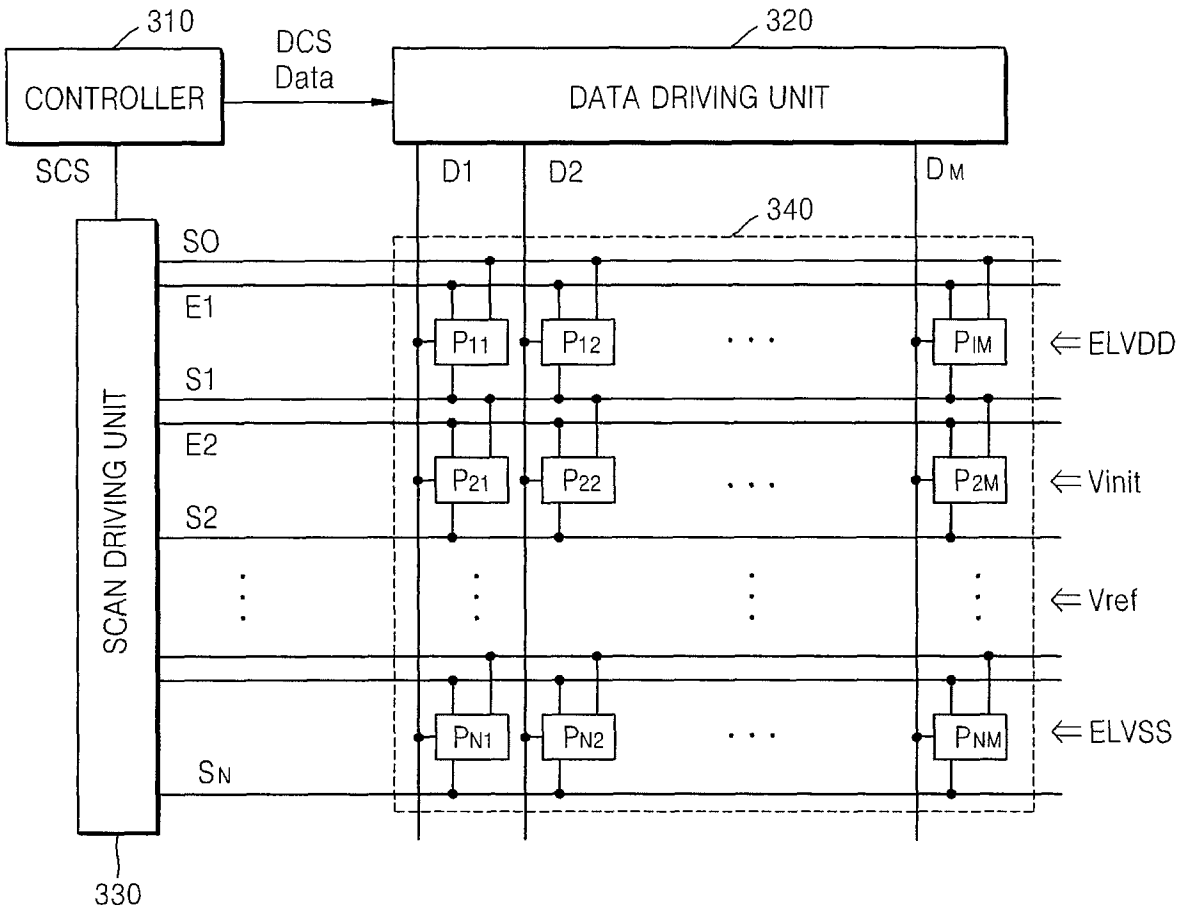
FIG. 3 is a diagram of an organic electroluminescent display apparatus according to an embodiment of the present invention.

FIG. 3 is a diagram of an organic electroluminescent display apparatus according to an embodiment of the present invention.

The organic electroluminescent display apparatus according to one embodiment includes a controller 310, a data driving unit 320 (e.g., a data driver), a scan driving unit 330 (e.g., a scan driver), and a pixel array 340.

The controller 310 generates RGB data and a data driving unit control signal DCS and outputs the generated RGB data and data driving unit control signal DCS to the data driving unit 320. Also, the controller 310 generates a scan driving unit control signal SCS and outputs the generated scan driving unit control signal SCS to the scan driving unit 330.

The data driving unit 320 generates the data signals D1 . . . Dm from the RGB data and outputs the generated data signals D1 . . . Dm to pixels $P_{11} \ldots P_{NM}$ of the pixel array 340, where N and M are natural numbers. The data driving unit 320 may generate the data signals D1 . . . Dm from the RGB data by using a gamma filter and a digital-to-analog conversion circuit. During a single scanning period, each of the data signals D1 . . . Dm may be concurrently output to pixels $P_{11} \ldots P_{NM}$ of the pixel array 340 located at the same row. In addition, each of a plurality of data lines which delivers the data signals D1 . . . Dm may be commonly connected to the pixels $P_{11} \ldots P_{NM}$ of the pixel array 340 located at the same column.

The scan driving unit 330 generates scan control signals S0 . . . Sn and emission control signals E0 . . . En from the scan driving unit control signal SCS and outputs the generated scan control signals S0 . . . Sn and emission control signals E0 . . . En to the pixels $P_{11} \ldots P_{NM}$ of the pixel array 340. Each of a plurality of scan control signal lines which deliver the scan control signals S0 . . . Sn and each of a plurality of emission control signal lines which deliver the emission control signals E0 . . . En may be commonly connected to the pixels $P_{11} \ldots P_{NM}$ of the pixel array 340 located at the same row. The scan control signals S0 . . . Sn and the emission control signals E0 . . . En may sequentially drive each row.

The scan driving unit 330 according to one embodiment may further output initialization control signals in order to initiate a voltage of the gate electrode of the driving transistor of each of the pixels $P_{11} \ldots P_{NM}$ of the pixel array 340. Each of the initialization control signals is output commonly to the pixels $P_{11} \ldots P_{NM}$ of the pixel array 340 located at the same row and sequentially drives each row. Each of the initialization control signals is applied before a corresponding one of the scan control signals S0 . . . Sn is applied. According to one embodiment, the initialization control signal may be a scan control signal Sn−1 of a previous row, as illustrated in FIG. 3. Accordingly, before a scan control signal S1 for the first row is applied, the scan driving unit 330 may further output an additional scan control signal S0 as an initialization control signal for the first row.

As illustrated in FIG. 3, the pixels $P_{11} \ldots P_{NM}$ of the pixel array 340 may be arranged in an N×M matrix. The plurality of pixels $P_{11} \ldots P_{NM}$ of the pixel array 340 may each include an OLED and a pixel circuit for driving the OLED. An anode power voltage ELVDD, an initialization voltage Vinit, a reference voltage Vref, and the cathode power voltage ELVSS may be applied to each of the pixels $P_{11} \ldots P_{NM}$ of the pixel array 340. According to one embodiment, the anode power voltage ELVDD may be used as the initialization voltage Vinit instead of applying the initialization voltage Vinit separately to each of the pixels $P_{11} \ldots P_{NM}$. In one embodiment, the initialization voltage Vinit is not provided to the pixels $P_{11} \ldots P_{NM}$ of the pixel array 340.

Figure 4:
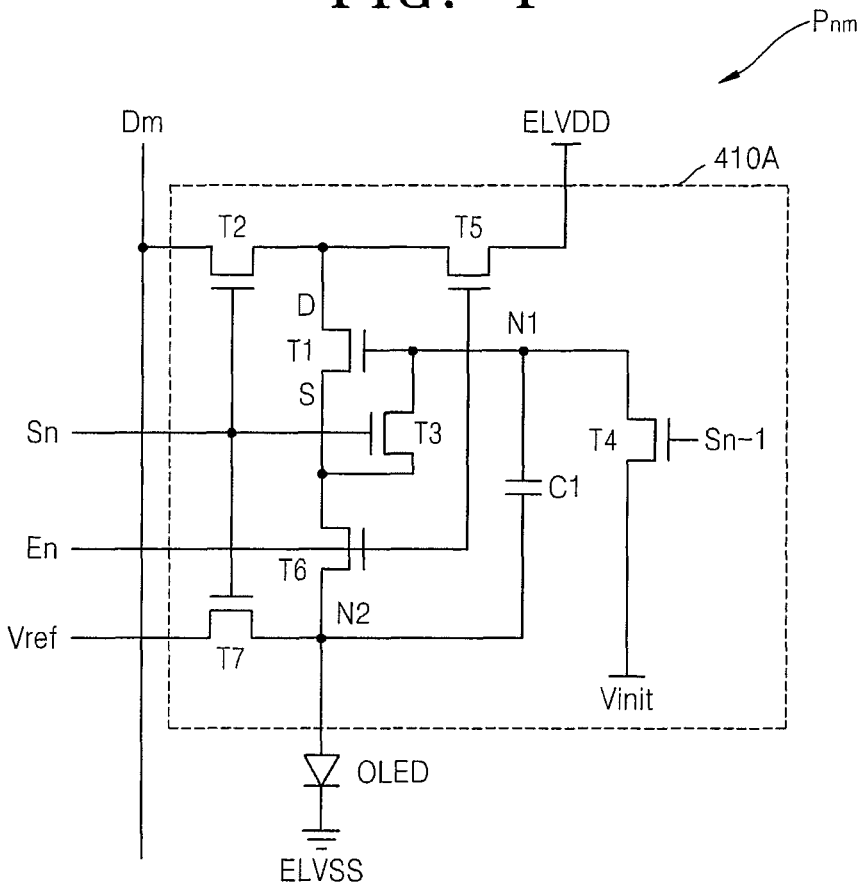
FIG. 4 is a diagram of a pixel circuit according to an embodiment of the present invention.

FIG. 4 is a diagram of a pixel circuit 410A according to an embodiment of the present invention.

A pixel Pnm located at the row n and the column m includes the pixel circuit 410A and an OLED. The pixel circuit 410A receives the data signal Dm from the data driving unit 320 through a data line and outputs the driving current $I_{OLED}$ according to the data signal Dm to the OLED. The OLED emits light having luminance corresponding to the amplitude of the driving current $I_{OLED}$.

The pixel circuit 410A according to one embodiment includes a driving transistor T1, second, third, fourth, fifth, sixth, and seventh transistors T2, T3, T4, T5, T6, and T7, and a capacitor C1.

The third transistor T3 includes a first electrode connected to the gate electrode of the driving transistor T1, a second electrode connected to the source electrode of the driving transistor T1, and a gate electrode connected to the scan control signal Sn. The gate electrode and source electrode of the driving transistor T1 are electrically connected to each other through the third transistor T3. The third transistor T3 electrically connects the gate electrode of the driving transistor T1 and the source electrode of the driving transistor T1 in response to the scan control signal Sn and thus diode-connects the driving transistor T1. Here, "diode-connect" denotes that a gate electrode and a source electrode of a transistor or a gate electrode and a drain electrode are connected to each other so that the transistor acts as a diode.

The fifth transistor T5 includes a first electrode connected to the anode power voltage ELVDD, a second electrode connected to a drain electrode of the driving transistor T1, and a gate electrode connected to the emission control signal En. The sixth transistor T6 includes a first electrode connected to the source electrode of the driving transistor T1, a second electrode connected to an anode of the OLED, and a gate electrode connected to the emission control signal En. When the emission control signal En is applied at a first level (e.g., a logic-high signal), which may turn on the driving transistor T1 and the second through seventh transistors T2 through T7, the drain electrode of the driving transistor T1 is connected to the anode power voltage ELVDD through the fifth transistor T5, and the source electrode of the driving transistor T1 is connected to the anode of the OLED through the sixth transistor T6.

The second transistor T2 includes a first electrode connected to a data line, a second electrode connected to the drain electrode of the driving transistor T1, and a gate electrode connected to the scan control signal Sn.

The capacitor C1 includes a first electrode connected to the gate electrode of the driving transistor T1 and a second electrode connected to the anode of the OLED.

The fourth transistor T4 includes a first electrode connected to the gate electrode of the driving transistor T1, a second electrode connected to the initialization voltage Vinit, and a gate electrode connected to the initialization control signal (e.g., Sn−1). In one embodiment, when the initialization control signal Sn−1 is applied at a high level, the fourth transistor T4 applies the initialization voltage Vinit to the gate electrode of the driving transistor T1 and the first electrode of the capacitor C1.

The seventh transistor T7 includes a first electrode connected to the reference voltage Vref, a second electrode connected to the anode of the OLED, and a gate electrode connected to the scan control signal Sn. In one embodiment, when the scan control signal Sn is applied at a high level, the seventh transistor T7 applies the reference voltage Vref to the anode of the OLED.

Figure 5:
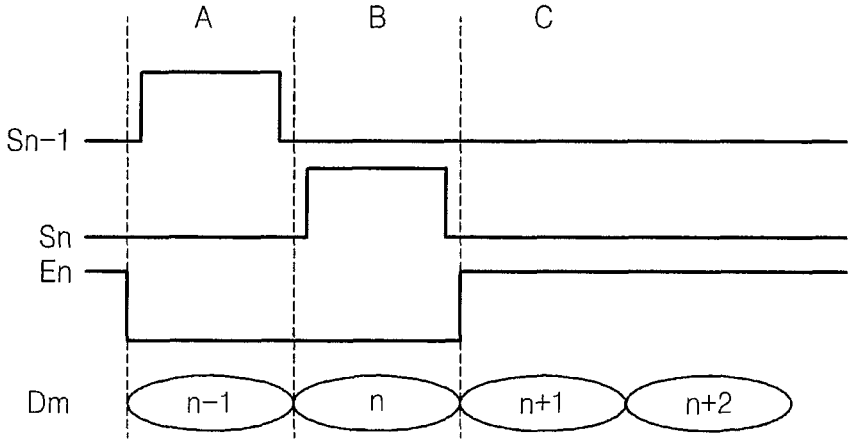
FIG. 5 is a timing diagram of driving signals, according to an embodiment of the present invention.

FIG. 5 is a timing diagram of driving signals, according to an embodiment of the present invention.

Figure 6A:
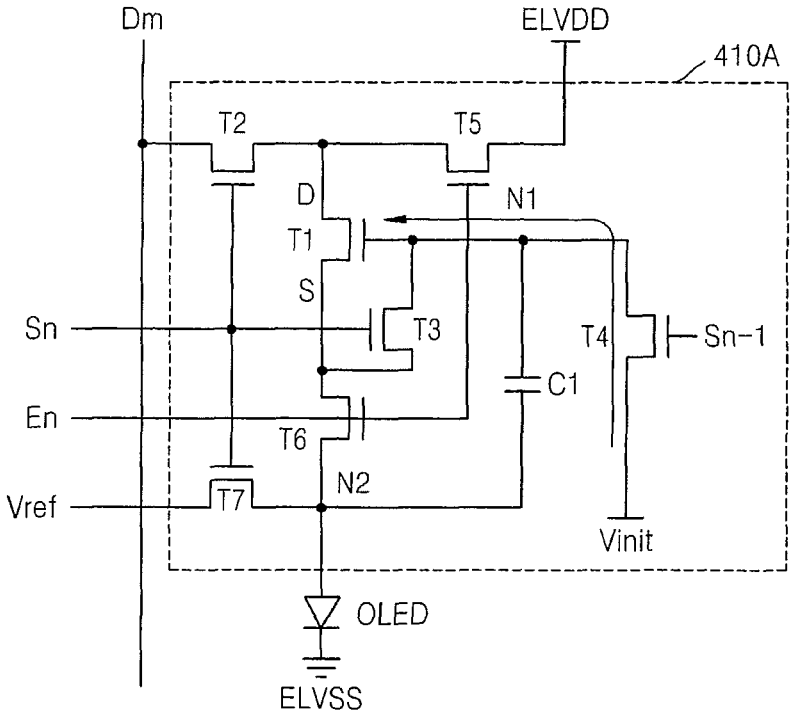
FIG. 6A is a diagram for illustrating an operation of a pixel circuit in a first time duration A.
Figure 6B:
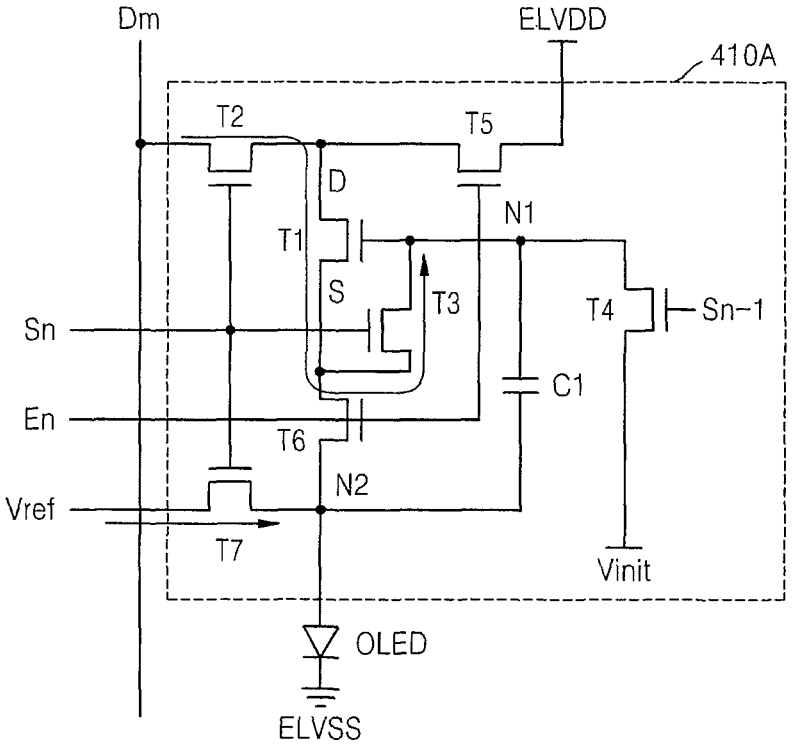
FIG. 6B is a diagram for illustrating an operation of a pixel circuit in a second time duration B.
Figure 6C:
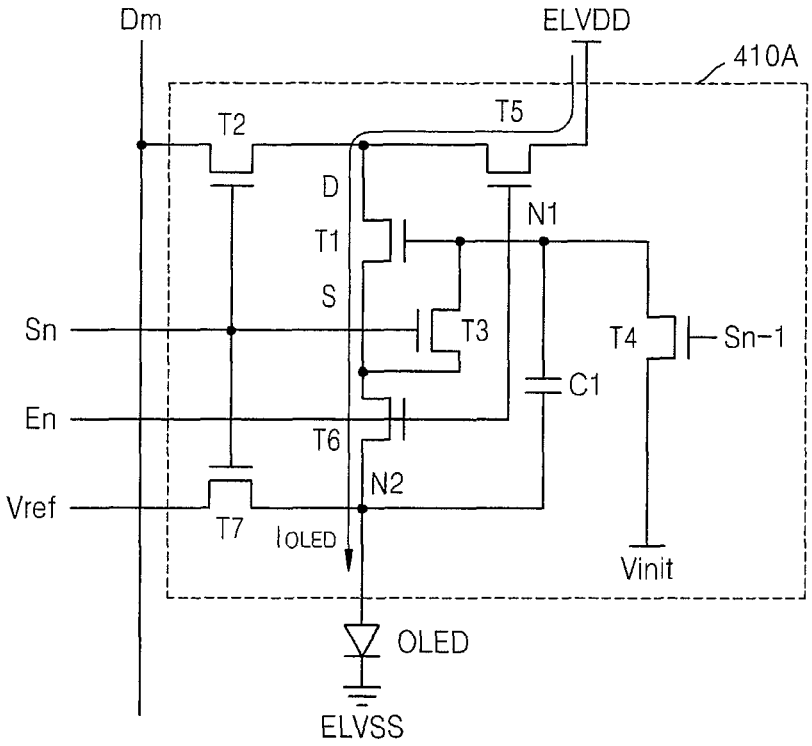
FIG. 6C is a diagram for illustrating an operation of a pixel circuit in a third time duration C.

Before a first time duration A, the driving current $I_{OLED}$ according to the data signal Dm of a previous frame flows through the OLED as illustrated in FIG. 6C, and thus the OLED emits light.

During the first time duration A, the initialization control signal Sn−1 is at a first level (e.g., a logic high level), and the scan control signal Sn and the emission control signal En are at a second level (e.g., a logic low level). Here, the first level is the level when the driving transistor T1 and the second through seventh transistors T2 . . . T7 are turned on, and the second level is the level when the driving transistor T1 and the second through seventh transistors T2 . . . T7 are turned off.

FIG. 6A illustrates an operation of the pixel circuit 410A in the first time duration A.

During the first time duration A, the scan control signal Sn and the emission control signal En are at the second level, and thus the second transistor T2, the third transistor T3, and the fifth through seventh transistors T5 . . . T7 are turned off. The fourth transistor T4 is turned on in response to the initialization control signal Sn−1 at the first level, and thus the initialization voltage Vinit is applied to a node N1. Due to the initialization voltage Vinit, the gate electrode of the driving transistor T1 and the first electrode of the capacitor C1 are initiated to the initialization voltage Vinit.

Next, during a second time duration B, the initialization control signal Sn−1 is changed to the second level, the scan control signal Sn is changed to the first level, and the emission control signal En remains in the second level.

FIG. 6B illustrates an operation of the pixel circuit 410A in the second time duration B.

Since the initialization control signal Sn−1 is changed to the second level during the second time duration B, the fourth transistor T4 is turned off. Also, since the scan control signal Sn is changed to the first level, the second and third transistors T2 and T3 are turned on, and as illustrated in FIG. 6B, the data signal Dm is applied to the gate electrode of the driving transistor T1 and the first electrode of the capacitor C1 through the second transistor T2, the driving transistor T1, and the third transistor T3 connected in series in this order. Here, the driving transistor T1 is diode-connected by the third transistor T3, and thus a voltage as much as the threshold voltage Vth of the driving transistor T1 is applied between the first electrode and the second electrode of the third transistor T3. Accordingly, a voltage Vdata+Vth is applied to the node N1. In addition, in the second time duration B, the seventh transistor T7 is turned on by the scan control signal Sn. Accordingly, the reference voltage Vref is applied to a node N2. Thus, during the second time duration B, a voltage (Vdata+Vth)-Vref is stored in the capacitor C1.

The reference voltage Vref has a voltage level at which the OLED is not turned on. Accordingly, the reference voltage Vref has a voltage level that is lower than the sum of the cathode power voltage ELVSS and the threshold voltage of the OLED.

Then, in a third time duration C, the scan control signal Sn is changed to the second level and the emission control signal En is changed to the first level. The initialization control signal Sn−1 remains in the second level.

FIG. 6C illustrates an operation of the pixel circuit 410A in the third time duration C.

During the third time duration C, the scan control signal Sn is changed to the second level, and thereby the second transistor T2, the third transistor T3, and the seventh transistor T7 are turned off. Also, the emission control signal En is changed to the first level, and thereby the fifth and sixth transistors T5 and T6 are turned on. Accordingly, the driving current $I_{OLED}$ according to the level of the voltage stored in the capacitor C1 is generated by the driving transistor T1. The driving current $I_{OLED}$ flows through the fifth transistor T5, the driving transistor T1, and the sixth transistor T6, and it is input to the anode of the OLED. Here, a voltage of the source electrode of the driving transistor T1 is the same as the voltage of the anode of the OLED, wherein the voltage of the anode of the OLED is ELVSS+$V_{OLED}$. Here, $V_{OLED}$ is a voltage applied between the terminals of the OLED. A voltage of the gate electrode of the driving transistor T1 is changed, as given by Equation 3, by coupling through the capacitor C1.

$$Vg=(V\text{data}+Vth)-V\text{ref}+(ELVSS+V_{OLED}) \quad \text{Equation 3}$$

Accordingly, during the third time duration C, Vgs of the driving transistor T1 is given by Equation 4.

$$\begin{aligned} Vgs &= Vg - Vs \\ &= [(Vdata + Vth) - Vref + (ELVSS + V_{OLED})] - (ELVSS + V_{OLED}) \\ &= Vdata + Vth - Vref \end{aligned} \quad \text{Equation 4}$$

The driving current $I_{OLED}$ determined by Vgs is determined according to Equation 5.

$$I_{OLED}=k(Vgs=Vth)^2=k[(V\text{data}+Vth=V\text{ref})=Vth]^2=k(V\text{data}=V\text{ref})^2 \quad \text{Equation 5}$$

Accordingly, the driving current $I_{OLED}$ output from the pixel circuit 410A according to the above-described embodiment is determined regardless of the voltage of the anode of the OLED, the cathode power voltage ELVSS, and the threshold voltage Vth of the driving transistor T1. Thus, in embodiments of the present invention, the problems that the amplitude of the driving current $I_{OLED}$ is changed due to the voltage of the anode of the OLED and thus the voltage of the data signal Dm should be increased or image quality is deteriorated can be resolved. In addition, image quality may not be deteriorated by a change of the cathode power voltage ELVSS.

Moreover, in embodiments of the present invention, since the data signal Dm is input through the driving transistor T1 and the third transistor T3 couples the driving transistor T1 as diode-connected, the threshold voltage Vth of the driving transistor T1 and the data signal Dm are stored using one capacitor C1 at the same time.

Figure 7:
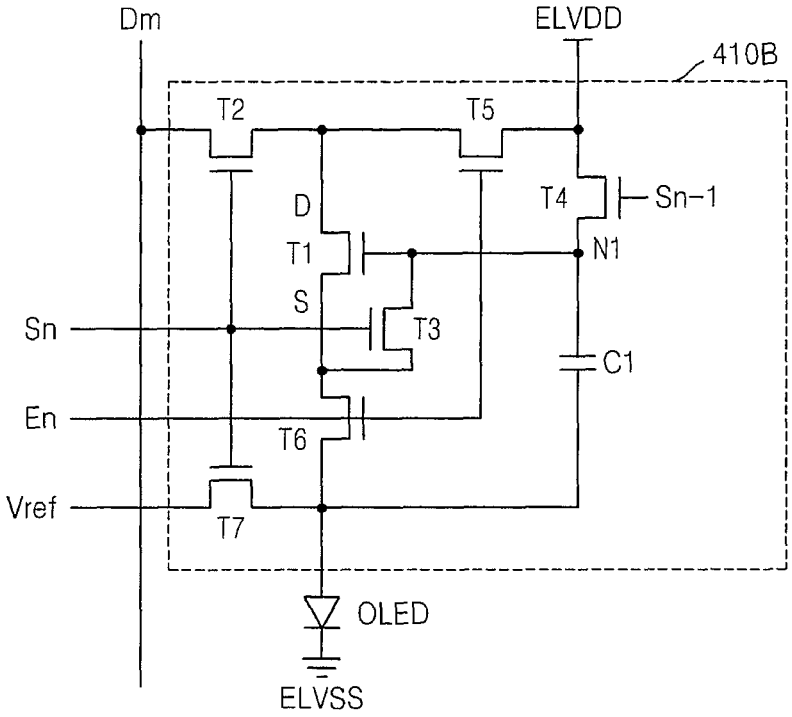
FIG. 7 is a diagram of a pixel circuit according to another embodiment of the present invention.

FIG. 7 is a diagram of a pixel circuit 410B according to another embodiment of the present invention.

According to one embodiment, the anode power voltage ELVDD may be used as the initialization voltage Vinit, instead of applying the initialization voltage Vinit separately. Thus, according to one embodiment, the second electrode of the fourth transistor T4 is connected to the anode power voltage ELVDD.

Figure 8:
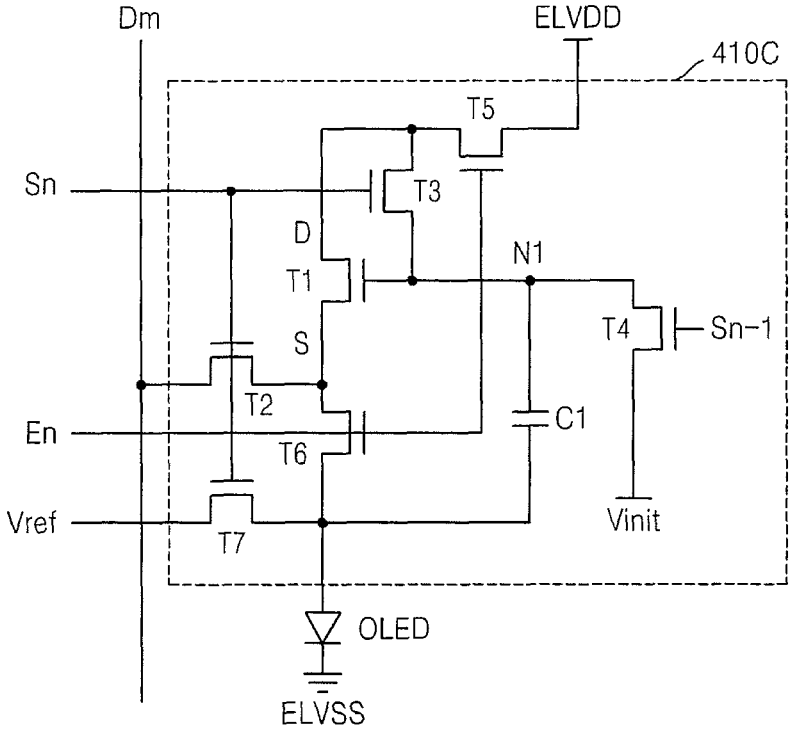
FIG. 8 is a diagram of a pixel circuit according to another embodiment of the present invention.

FIG. 8 is a diagram of a pixel circuit 410C according to another embodiment of the present invention.

According to one embodiment, an arrangement of the second transistor T2 and the third transistor T3 is changed. In one embodiment, the second electrode of the second transistor T2 is connected to the source electrode of the driving transistor T1, and the second electrode of the third transistor T3 is connected to the drain electrode of the driving transistor T1.

Figure 9:
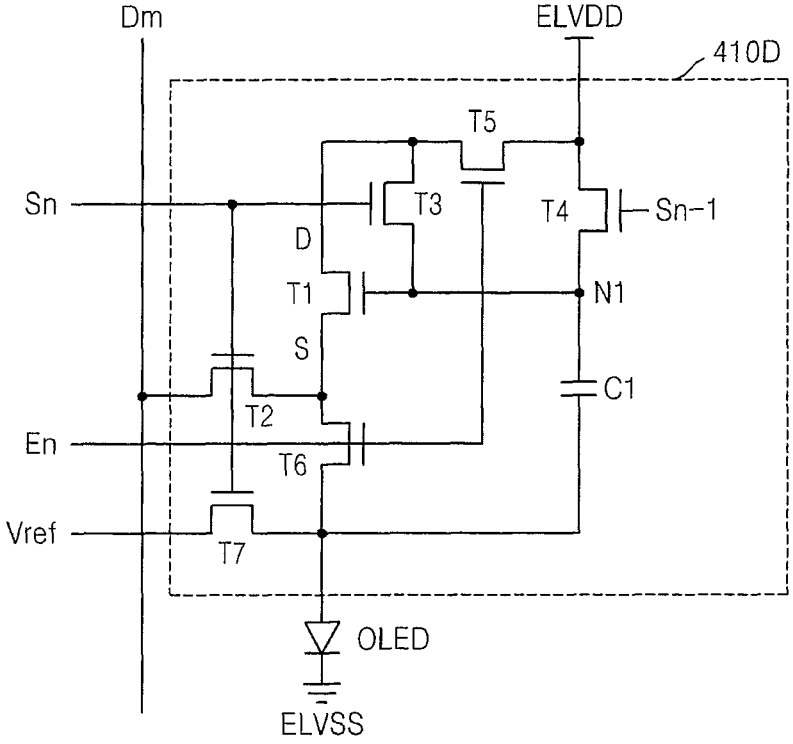
FIG. 9 is a diagram of a pixel circuit according to another embodiment of the present invention.

FIG. 9 is a diagram of a pixel circuit 410D according to another embodiment of the present invention.

According to one embodiment, the second electrode of the second transistor T2 is connected to the source electrode of the driving transistor T1, and the second electrode of the third transistor T3 is connected to the drain electrode of the driving transistor T1. Also, the anode power voltage ELVDD is used as an initialization voltage instead of applying the initialization voltage Vinit separately. Accordingly, the second electrode of the fourth transistor T4 is connected to the anode power voltage ELVDD.

Figure 10:
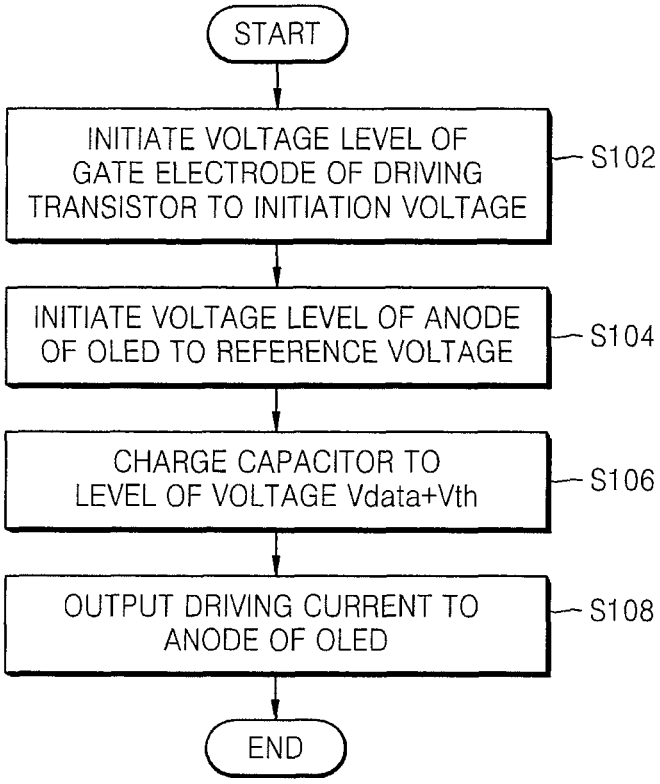
FIG. 10 is a flowchart for illustrating a method of driving an organic electroluminescent display apparatus, according to an embodiment of the present invention.

FIG. 10 is a flowchart illustrating a method of driving an organic electroluminescent display apparatus, according to an embodiment of the present invention.

The method of driving the organic electroluminescent display apparatus, according to one embodiment of the present invention, is described with reference to the timing diagram illustrated in FIG. 5.

During the first time duration A, the gate electrode of the driving transistor T1 is initiated to the initialization voltage Vinit in response to the initialization control signal Sn−1, in operation S102. According to one embodiment, the initialization voltage Vinit may be the anode power voltage ELVDD.

Then, during the second time duration B, the anode of the OLED is initiated to the reference voltage Vref in response to the scan control signal Sn, in operation S104. The reference voltage has a voltage level at which the OLED is not turned on, and is lower than the sum of the cathode power voltage ELVSS and the threshold voltage of the OLED. Also, during the second time duration B, the capacitor C1 is charged to a level of the voltage Vdata+Vth by using the data signal Dm applied through the second transistor T2, the driving transistor T1, and the third transistor T3 in response to the scan control signal Sn, in operation S106. The data signal Dm is at a level of the voltage Vdata, and the driving transistor T1 is diode-connected by the third transistor T3 so that a voltage difference between the gate electrode and the source electrode (or drain electrode) of the driving transistor T1 becomes the voltage Vth. Accordingly, the capacitor C1 is charged to a level of the voltage Vdata+Vth. Operations S104 and S106 may be simultaneously or concurrently performed or sequentially performed in some embodiments.

Next, during the third time duration C, the driving current $I_{OLED}$ is output to the anode of the OLED, in operation S108. The amplitude of the driving current $I_{OLED}$ is determined according to the voltage level Vdata of the data signal Dm as illustrated in FIG. 5, and the OLED emits light having luminance according to the amplitude of the driving current $I_{OLED}$.

According to the embodiments of the present invention, the driving current output to the organic electro-light emitting device is determined regardless of the voltage of the anode of the organic electro-light emitting device. Thus, when N-type transistors are used to realize the organic electro-light emitting device, a problem in which the luminance of light is changed by a change of the Vgs of the driving transistor due to a change of the voltage of the anode in the organic electro-light emitting device may be prevented. In addition, the driving current is determined regardless of the cathode driving voltage so that the luminance of light may not be affected by a change of the cathode driving voltage, and image quality may not be deteriorated.

While aspects of the present invention has been particularly shown and described with reference to exemplary embodiments thereof, it will be understood by those of ordinary skill in the art that various changes in form and details may be made therein without departing from the spirit and scope of the present invention as defined by the following claims and their equivalents.

What is claimed is:

1. A pixel circuit for driving a light emitting device comprising an anode electrode and a cathode electrode, the pixel circuit comprising:

a driving transistor comprising a first electrode and a second electrode for outputting a driving current according to a voltage applied to a gate electrode of the driving transistor;

a second transistor for delivering a data signal to the gate electrode of the driving transistor in response to a scan control signal applied to a gate electrode of the second transistor;

a third transistor for diode-connecting the driving transistor in response to the scan control signal applied to a gate electrode of the third transistor;

a fourth transistor for applying an initialization voltage to the gate electrode of the driving transistor in response to an initialization control signal;

a fifth transistor for applying a first power voltage to the second electrode of the driving transistor in response to an emission control signal;

a sixth transistor directly electrically connected in series between the first electrode of the driving transistor and the anode electrode of the light emitting device for outputting the driving current output from the driving transistor to the anode electrode of the light emitting device in response to the emission control signal applied to a gate electrode of the sixth transistor;

a seventh transistor for applying a reference voltage to the anode electrode of the light emitting device in response to the scan control signal applied to a gate electrode of the seventh transistor; and a capacitor comprising a first electrode and a second electrode, wherein the first electrode is directly electrically connected to the gate electrode of the driving transistor and the fourth transistor and wherein the second electrode is directly electrically connected to the anode electrode of the light emitting device and the seventh transistor, wherein the pixel circuit is configured such that the data signal is delivered to the gate electrode of the driving transistor through the second transistor, the driving transistor, and the third transistor, and wherein the driving transistor and the second, third, fourth, fifth, sixth, and seventh transistors are N-type transistors.

2. The pixel circuit of claim 1, wherein the light emitting device comprises an organic light-emitting diode.

3. The pixel circuit of claim 1, wherein the second transistor comprises a first electrode for receiving the data signal and a second electrode electrically connected to the second electrode of the driving transistor, and the third transistor comprises a first electrode electrically connected to the gate electrode of the driving transistor and a second electrode electrically connected to the first electrode of the driving transistor.

4. The pixel circuit of claim 3, wherein the initialization voltage is substantially the same as the first power voltage.

5. The pixel circuit of claim 1, wherein the cathode electrode of the light emitting device is configured to receive a second power voltage, and the reference voltage is lower than a sum of the second power voltage and a threshold voltage of the light emitting device.

6. The pixel circuit of claim 1, wherein the initialization control signal is a scan control signal of a previous scan period.

7. The pixel circuit of claim 1, wherein the driving transistor and the second, third, fourth, fifth, sixth, and seventh transistors are N-type metal-oxide semiconductor field effect transistors.

8. The pixel circuit of claim 1, wherein the first electrode of the driving transistor is a source electrode, and the second electrode of the driving transistor is a drain electrode.

9. The pixel circuit of claim 1, wherein the pixel circuit is configured such that:

during a first time duration, when the initialization control signal is at a first level, the scan control signal and the emission control signal are at a second level;

during a second time duration, when the data signal has a valid level, the initialization control signal and the emission control signal are at the second level, and the scan control signal is at the first level; and during a third time duration, when the initialization control signal and the scan control signal are at the second level, the emission control signal is at the first level, and wherein the first level is a level at which the driving transistor and the second, third, fourth, fifth, sixth, and seventh transistors are turned on, and the second level is a level at which the driving transistor and the second, third, fourth, fifth, sixth, and seventh transistors are turned off.

10. The pixel circuit of claim 1, wherein the second transistor comprises a first electrode electrically connected to the data signal and a second electrode electrically connected to the first electrode of the driving transistor, and the third transistor comprises a first electrode electrically connected to the gate electrode of the driving transistor and a second electrode electrically connected to the second electrode of the driving transistor.

11. The pixel circuit of claim 10, wherein the initialization voltage is the first power voltage.

12. An organic electroluminescent display apparatus comprising:

a pixel array comprising a plurality of pixels;

a scan driver configured to output an initialization control signal, a scan control signal, and an emission control signal to the plurality of pixels; and a data driver configured to generate a data signal and output the data signal to the plurality of pixels, wherein each of the plurality of pixels comprises:

an organic light-emitting diode (OLED) comprising an anode electrode and a cathode electrode;

a driving transistor comprising a first electrode and a second electrode for outputting a driving current according to a voltage applied to a gate electrode of the driving transistor;

a second transistor for delivering a data signal to the gate electrode of the driving transistor in response to a scan control signal applied to a gate electrode of the second transistor;

a third transistor for diode-connecting the driving transistor in response to the scan control signal applied to a gate electrode of the third transistor;

a fourth transistor for applying an initialization voltage to the gate electrode of the driving transistor in response to an initialization control signal;

a fifth transistor for applying a first power voltage to the second electrode of the driving transistor in response to an emission control signal;

a sixth transistor directly electrically connected in series between the first electrode of the driving transistor and the anode electrode of the OLED for outputting the driving current output from the driving transistor to the anode electrode of the OLED in response to the emission control signal applied to a gate electrode of the sixth transistor;

a seventh transistor for applying a reference voltage to the anode electrode of the OLED in response to the scan control signal applied to a gate electrode of the seventh transistor; and a capacitor comprising a first electrode and a second electrode, wherein the first electrode is directly electrically connected to the gate electrode of the driving transistor and the fourth transistor and wherein the second electrode is directly electrically connected to the anode electrode of the OLED and the seventh transistor, wherein the second transistor is configured to deliver the data signal to the gate electrode of the driving transistor through the second transistor, the driving transistor, and the third transistor, and wherein the driving transistor and the second, third, fourth, fifth, sixth, and seventh transistors are N-type transistors.

13. The apparatus of claim 12, wherein the second transistor comprises a first electrode configured to receive the data signal and a second electrode electrically connected to the second electrode of the driving transistor, and the third transistor comprises a first electrode electrically connected to the gate electrode of the driving transistor and a second electrode electrically connected to the first electrode of the driving transistor.

14. The apparatus of claim 12, wherein the cathode electrode of the OLED is configured to receive a second power voltage, and the reference voltage is lower than a sum of the second power voltage and a threshold voltage of the OLED.

15. The apparatus of claim 12, wherein the scan driver is configured such that:

during a first time duration, when the initialization control signal is at a first level, the scan control signal and the emission control signal are at a second level;

during a second time duration, when the data signal has a valid level, the initialization control signal and the emission control signal are at the second level, and the scan control signal is at the first level; and during a third time duration, when the initialization control signal and the scan control signal are at the second level, the emission control signal is at the first level, wherein the first level is a level at which the driving transistor and the second, third, fourth, fifth, sixth, and seventh transistors are configured to be turned on, and the second level is a level at which the driving transistor and the second, third, fourth, fifth, sixth, and seventh transistors are configured to be turned off.

16. The apparatus of claim 15, wherein the initialization control signal is a scan control signal of a previous scan period.

17. The apparatus of claim 12, wherein the second transistor comprises a first electrode configured to receive the data signal and a second electrode electrically connected to the first electrode of the driving transistor, and the third transistor comprises a first electrode electrically connected to the gate electrode of the driving transistor and a second electrode electrically connected to the second electrode of the driving transistor.

18. A method of driving an organic electroluminescent display apparatus comprising a pixel array comprising a plurality of pixels, the method comprising:

initializing a gate electrode of a driving transistor to an initialization voltage by applying the initialization voltage via an initialization transistor;

supplying a scan control signal to a first transistor to initialize an anode of an organic light-emitting diode (OLED) to a reference voltage by supplying the reference voltage through the first transistor;

supplying the scan control signal to a second transistor to charge a capacitor to a voltage level corresponding to a sum of a threshold voltage of the driving transistor and a data signal by diode-connecting the driving transistor and applying the data signal to a gate electrode of the driving transistor, wherein the capacitor comprises a first electrode directly electrically connected to the gate electrode of the driving transistor and the initialization transistor and a second electrode directly electrically connected to the anode of the OLED and the first transistor; and outputting a driving current from the driving transistor to the anode of the OLED, through a third transistor directly electrically connected to the anode of the OLED and the first transistor, according to a level of a voltage charged to the capacitor, wherein one of the plurality of pixels comprises the OLED and a pixel circuit that comprises N-type transistors, which comprise the driving transistor, the first transistor, and the second transistor, and the capacitor electrically connected between the gate electrode of the driving transistor and the anode of the OLED.

19. The method of claim 18, wherein a cathode of the OLED is configured to receive a second power voltage, and the reference voltage is lower than a sum of the second power voltage and a threshold voltage of the OLED.

* * * * *